United States Patent [19]

Pong

[11] Patent Number: 4,514,866

[45] Date of Patent: May 7, 1985

[54] BUOYANT METERING DISPENSER

[76] Inventor: Richard G. S. Pong, 132 Spring St., Passaic Park, N.J. 07055

[21] Appl. No.: 503,000

[22] Filed: Jun. 10, 1983

[51] Int. Cl.[3] ..... E03D 9/03

[52] U.S. Cl. ..... 4/228

[58] Field of Search ..... 4/227, 228

[56] References Cited

U.S. PATENT DOCUMENTS

| | | | |
|---|---|---|---|
| 1,002,974 | 9/1911 | Dunkley | 4/227 |
| 1,227,997 | 5/1917 | Clifford | 4/227 |
| 1,977,111 | 10/1934 | Cashion | 137/79 |
| 2,888,685 | 11/1957 | Giangrosso et al. | 4/227 |
| 3,618,143 | 11/1971 | Hill et al. | 4/228 |
| 4,296,503 | 10/1981 | Leardi | 4/227 X |
| 4,370,763 | 2/1983 | Dolan | 4/228 |
| 4,451,941 | 6/1984 | Gray | 4/228 |

*Primary Examiner*—Charles E. Phillips

*Attorney, Agent, or Firm*—David A. Jackson; Daniel H. Bobis

[57] ABSTRACT

A buoyant dispenser for periodic delivery of a metered quantity of a dispensable material comprises a container having a central receptacle to hold the dispensable material, buoyancy means such as pontoons straddling the receptacle, a cover in fluid-tight engagement with the receptacle, an attitude guide means attached to the container that is adapted to be anchored to a wall of the fluid reservoir and a metering means in fluid registry with the receptacle to permit controlled ingress and egress of the fluid and dispensable material. Preferably, the metering means comprises a pair of holes disposed in spaced apart relation to each other, and positioned to allow a predetermined quantity of dispensable material to escape from the receptacle. In one embodiment, the receptacle is divided into two compartments by a transverse partition, and the metering means comprises holes communicating with one of the compartments, so that the dispensable material in that compartment is discharged when the dispenser in the fully floating position. The present dispenser finds particular utility in fluid reservoirs having cyclically variable fluid levels, and is particularly suited for use in the water tank of a domestic toilet apparatus.

17 Claims, 8 Drawing Figures

BUOYANT METERING DISPENSER

BACKGROUND OF THE INVENTION

1. Field of the Invention

The present invention relates to dispensers for the delivery of materials in liquid or solution form, and more particularly to such dispensers as are useful in fluid reservoirs having cylic variation in fluid level.

2. Description of the Prior Art

Numerous dispensers are known, that are capable of storing and discharging their contents when placed within fluid reservoirs having cyclic change in fluid level. An example of such a fluid reservoir, is the water tank that is normally associated with the toilet boil of a domestic bathroom toilet apparatus. In such instance, it has long been desirable to dispense a quantity of a cleanser, deodorant or the like, to circulate through the toilet apparatus, to disinfect and clean the walls of the toilet bowl, to maintain the apparatus in hygienic condition.

Representative dispensing devices known in the prior art include the device shown in U.S. Pat. No. 1,002,974 to Dunkley, which shows a reservoir containing a quantity of disinfectant, which is positioned within a larger fluid container or cistern. The disinfectant container has a trough hingeably associated with it, and adapted to alternately scoop up a portion of the fluid in the cistern and transfer it into the disinfectant container. By this means, the disinfectant container is mixed with a quantity of the fluid ambient and, when the total fluid capacity of the disinfectant container is exceeded, a solution containing disinfectant is discharged at the spout.

U.S. Pat. No. 1,227,997 to Clifford discloses a pivoting dispenser adapted to reside within a tank containing a body of fluid, to alternately dispense a quantity of an antiseptic thereinto. The Clifford device utilizes a float such as indicated at 22, which controls the angle and frequency of the tilt of the antiseptic dispenser, and thereby the quantity of fluid released through the nozzle orifice when the dispenser tilts toward the vertical. The Clifford device, however, does not offer the uniform discharge of a premeasured amount of antiseptic, as the amount of discharge will vary with the angle and residence time of the dispenser.

U.S. Pat. No. 2,888,685 to Giangrosso et al discloses a dispenser device for use with a toilet bowl tank that is mountable on the float arm and dispenses a quantity of deodorant when the float arm lowers as the fluid in the tank is drained. This device uses a ball and check valve to permit discharge, which may introduce inaccuracies and nonuniformities in operation. Similarly then, this device cannot assure that a predetermined quantity of deodorant is always dispensed.

Finally, U.S. Pat. No. 4,296,503 to Leardi discloses a dispenser that is mountable within a toilet bowl tank and is adapted to pivot from a floating position to an essentially veritical, dispensing position to discharge a quantity of a deodorant or detergent composition. The Leardi device has an essentially open upper surface that permits unlimited contact with the fluid in the toilet bowl tank with the solid cake of material positioned within the container. The Leardi device shows no means for metering the amount of deodorant or cleaner that will be discharged into the water tank. The consequence of this inability is that the device may discharge an excess of deodorant or cleanser initially, and may thereafter discharge inadequate amounts and ultimately will be totally expended prematurely. As a consequence, the efficiency of operation of the device of Leardi is relatively low.

In similar fashion, those devices in the prior art that appear to offer some metering capability are complex in construction and operation and are correspondingly unreliable. A need therefore exists for the development of a dispensing device that offers simplicity in construction and operation, and reliability of uniformity in the metering of the active ingredient contained therein.

SUMMARY OF THE INVENTION

In accordance with the present invention a buoyant dispenser is disclosed for suspension in a fluid reservoir having a cyclically variable fluid level, for the periodic delivery of a metered quantity of a dispensable material. The dispenser comprises a container having a central receptacle for holding the dispensable material, buoyancy means communicating with the container and straddling the receptacle, a cover in fluid tight engagement with the receptacle, attitude guide means attached to the container and adapted to be anchored to the wall of the fluid reservoir and a metering means in fluid registry with the receptacle to permit the controlled ingress and egress of the fluid.

More particularly, the central receptacle of the container has a mouth which in turn, is attached to an extended rim or lip. The receptacle may have a greater longitudinal dimension and may in one embodiment be essentially rectangular. The buoyancy means may comprise pontoon-like structures such as sealed air chambers, foamed resinous strips or other floatation devices, and may in one embodiment be attached to the rim of the container. The cover extends over the mouth of the receptacle, and may further be coextensive with the rim. In such instance, the buoyancy means may be attached to the peripheral portions of the cover.

The attitude guide means includes a connector hingably attached to one end to the container, and having an anchor means such as one or more clips attached to its free end. The connector may be a flexible sheet, a wire or a chain attached to the peripheral edge of the rim of the container, which by limiting the vertical movement of the container, would cause it to rotate into an essentially vertical attitude when the fluid is draining from the reservoir falls below a level offering horizontal support to the dispenser. In this attitude, and as described later on herein, the dispensable material may either be discharged, or appropriately mixed in solution with the fluid to be treated, whereupon discharge of the resulting solution would take place after the fluid level in the reservoir rises, and the container resumes its fully buoyant disposition.

The metering means preferably comprises two centrally positioned holes that, in one embodiment, are both positioned in said cover in spaced apart relation to each other. In an alternate embodiment, each of the holes is positioned respectively in the cover and the corresponding wall of the receptacle, and may further be in substantial axial alignment with each other.

In an alternate embodiment of the invention, the container having the receptacle with a greater longitudinal dimension may be divided by a partition extending transverse to this greater longitudinal dimension, and having a height less than the depth of the receptacle. In this embodiment the transverse partition divides the receptacle into a larger volume compartment and a smaller volume compartment. The hole defined by the container passes through the smaller volume compartment, and a corresponding hole is disposed on the portion of the cover extending thereover. In this embodiment, the container fills with a quantity of fluid when the fluid level of the reservoir is at its maximum, and this quantity is thereafter mixed with the dispensable material when the container assumes the changed attitude as the fluid drains from the reservoir. Upon the refilling of the reservoir, the container resumes its original attitude and the prepared solution of fluid and dispensable material is discharged into the ambient fluid body.

The present dispenser confers the advantages of simplicity of design and corresponding manufacture, while providing for the desired isolation and regulated metering of the dispensable material. The container may be constructed as a throw-away item, or may be refillable, in the instance where the cover is snap fittably engaged to the container. The absence of complex parts reduces manufacturing costs and corresponding maintenance in use. Moreover, the design of the present dispenser makes it possible to dispense either solid or liquid material, without concern that premature discharge of excessive dispensable material will take place.

The present dispenser finds use in a variety of environments, including cattle feed stations and other fluid reservoirs with cyclical fluid variation. A particularly pertinent domestic use for the present dispenser, is in the tank of a domestic toilet apparatus.

Accordingly, it is a principal object of the present invention to provide a buoyant dispenser which may be suspended in a reservoir having a cyclically variable fluid level, that is capable of releasing a metered quantity of a dispensable material thereto.

It is a further object of the present invention to provide a buoyant dispenser as aforesaid that is of simple and inexpensive construction and operation.

It is a yet further object of the present invention to provide a buoyant dispenser as aforesaid that is capable of the isolated storage of said dispensible material.

It is a still further object of the present invention to provide a buoyant dispenser as aforesaid that is capable of releasing a uniform quantity of dispensable material on a regular basis.

Other objects and advantages will become apparent to those skilled in the art from a review of the ensuing description which proceeds with reference to the following illustrative drawings.

DETAILED DESCRIPTION

Figure 1:
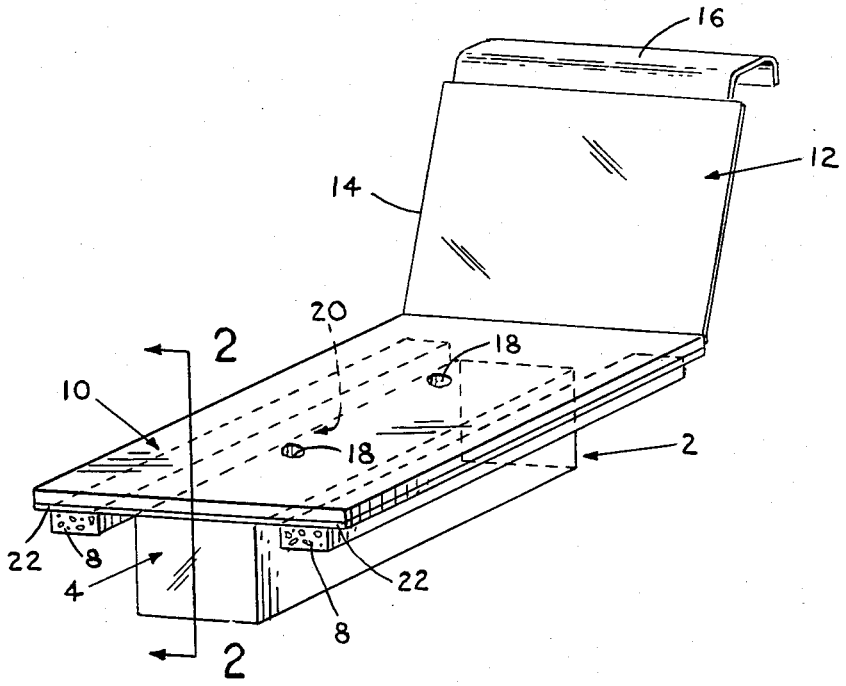
FIG. 1 is a perspective view partly in phantom of a dispenser in accordance with a first embodiment of the present invention.

Referring now to the drawings wherein like numerals designate like parts, and generally to FIG. 1, dispenser 2 in accordance with the present invention is shown in perspective and comprises a container 4, with a central receptacle 6 provided to hold a quantity of a dispensable material. As mentioned earlier herein, the dispensable material may be in solid or liquid form, and may comprise a chemical compound or composition having specific activity depending upon the environment of the fluid contained by the reservoir in which the present dispenser is to be placed. In the instance where the reservoir is a toilet tank, the dispensable material may comprise one of many well known disinfectants, scale-removing agents and the like. As the present invention relates primarily to the dispenser, and not to the contents dispensed, further details regarding the exact compositions of the dispensable material are not provided herein.

Referring further to FIG. 1, dispenser 2 includes buoyancy means such as pontoons 8 which as shown, communicate with container 4 and straddle receptacle 6. In the embodiment shown in the FIGURES, the pontoons 8 appear to be attached to container 4. As explained later on herein, pontoons 8 may be attached to the cover 10 instead.

Buoyancy means or pontoons 8 may comprise fluid-tight receptacles containing ambient air, such as suggested in the FIGURES. Alternately, pontoons 8 may comprise strips of buoyant material such as foamed resinous materials, sponge or the like. In this latter event, strips of foamed resinous material may be glued to either container 4 or cover 10, in the general straddling position illustrated in the FIGURES, to provide the desired buoyant support to the dispenser 2 when it is disposed in a floating position on a body of fluid.

As shown in phantom in FIG. 1, receptacle 6 has an open end defining a mouth 20 which, when dispenser 2 is in the essentially horizontal, floating position, constitutes the upper most extent of the fluid capacity of receptacle 6. Mouth 20 is attached to an extended rim 22 which defines the full horizontal perimeter of container 4, and as illustrated, may serve as the points of attachment of pontoons 8. For example, in the instance where pontoons 8 are fluid-tight air receptacles, container 4 may be formed as one piece with the primary receptacle 6 and the air receptacles positioned along rim 22 as shown. Thereafter, the cover 10 may be sealingly applied to container 4 and by this procedure will render the pontoons fluid-tight and thereby operable.

Cover 10 is disposed in fluid-tight engagement with receptacle 6 as shown, and more particularly, may extend into engagement with mouth 20. In one embodiment, not shown, mouth 20 may provide a rim for the removable engagement of a suitable cover 10, and the latter may be snap fittably attached, and thereafter detached for recharging with dispensable material.

In the more common instance where dispenser 2 is not intended for re-use, cover 10 may be coextensive with rim 22 and may be sealingly bonded thereto by a variety of methods known in the art. Thus, for example, cover 10 may be glued to the mating surfaces of rim 22, which as indicated earlier, may be configured to define pockets or receptacles that will contain or themselves become pontoons 8. In this connection, the receptacles designated by the numeral 8 may also contain appropriate foamed material that itself would lend sufficient buoyancy to the dispenser 2.

Attitude guide means 12 comprises a connector 14 which as illustrated in FIG. 1 may comprise a flexible sheet. Connector 14 extends from attachment to a peripheral margin of rim 22, and is provided with a length sufficient to permit the container to rotate from the essentially horizontal, buoyant position shown in FIG. 1 to the vertical, suspended position illustrated in FIG. 4. As will be described later on herein with regard to the operation of the present dispenser, this capability for change in attitude or rotation, in cooperation with the metering means of the present invention, facilitates the uniform repeated release of a predetermined quantity of dispensable material to the fluid ambient of the reservoir on a regulated basis, while storing and isolating the remainder of the dispensable material from the external fluid ambient.

Connector 14 as illustrated comprises a flexible sheet, however it is to be understood that a plurality of wires, cables or similar filamentry material may be utilized instead. For example, two wires or filaments may be connected to corners of the peripheral margin of container 4, in approximately the position of the lateral margins of the sheet illustrated in FIG. 1, and as actually illustrated in FIG. 5. In such instance where a flexible connector is utilized, there is no need for specific flexible hinge means disposed between the connector 14 and the margin of container 4. However when connector 14 is rigid, some form of hinge means, such as a flexible connector sheet, formal hinge, etc., not illustrated herein, may be necessary. The present invention is intended to encompass this modification within its spirit and scope.

Connector 14 terminates at its free end in anchor means 16 which, as illustrated, may comprise a generally U-shaped clip in the instance where the dispenser 2 is suspended from the wall of a water tank such as that used in conjunction with domestic toilet fixtures. Naturally, while anchor means 16 as illustrated is a single clip, in the instance where multiple filaments are used as connector 14, a comparable number of clips may serve as anchor means 16. The present invention is intended to encompass multiple connectors 14 and anchor means 16 within its scope. Likewise, variant anchor means not illustrated herein, such as permanently attachable brackets, hook and eyelet arrangements, removably attachable adhesive strips and the like may serve as the anchoring means within the scope of the invention.

The metering means of the dispenser of the present invention is illustrated at 18 and is in fluid registry with the receptacle 6 to permit the controlled ingress and egress of the ambient fluid, and the corresponding release of dispensable material from the dispenser 2. Metering means 18 comprise paired holes that are centrally positioned and spaced apart from each other. In the embodiment illustrated in FIGS. 1–4, holes 18 are positioned centrally along cover 10 as best illustrated in FIG. 1. In the instance the receptacle has a greater longitudinal dimension, as in the embodiments illustrated herein, the holes 18 are disposed in substantial alignment with the longitudinal dimension.

In the embodiment illustrated in FIGS. 1–4, and as will be described with respect to the operation thereof, the hole 18 proximate to connector 14 serves primarily to equalize the air pressure between the external ambient and the interior of receptacle 6, to permit unimpeded ingress and egress of fluid and dispensable material. The hole 18 distal with respect to connector 14 is the port through which fluid passes in operation. This hole is positioned in relation to the quantity of fluid that it is desired to periodically dispense, as will be seen with reference to FIGS. 2–4 discussed hereinafter with respect to the operation of dispenser 2.

Figure 3:
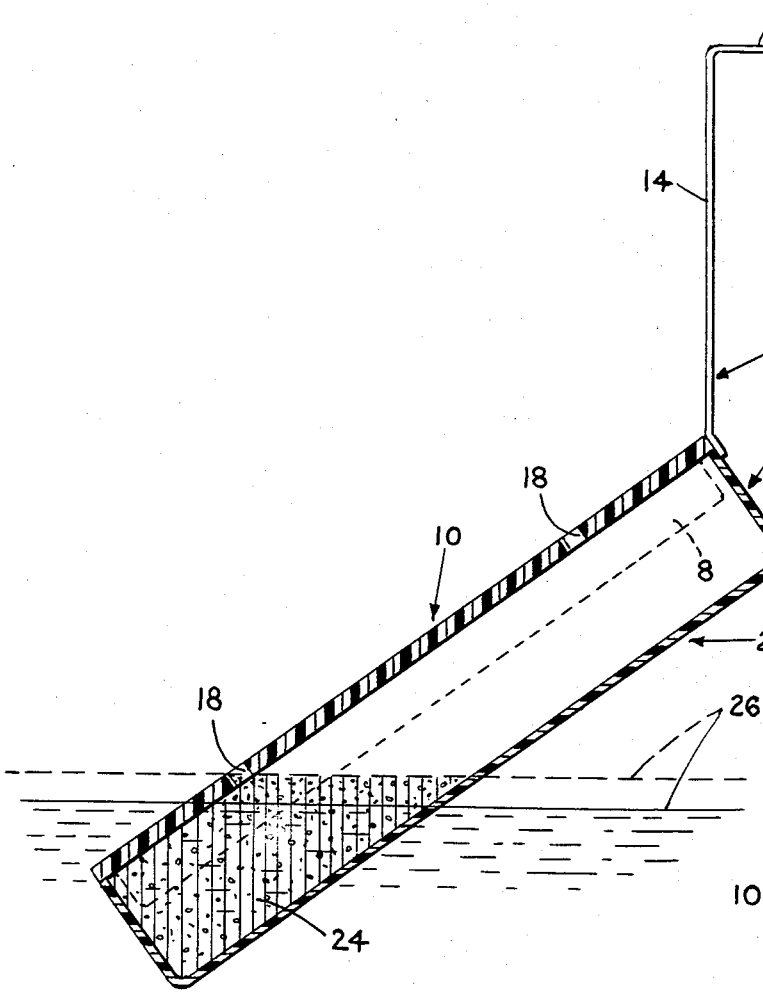
FIG. 3 is a side sectional view similar to FIG. 2, showing the dispenser in the tilted position.
Figure 4:
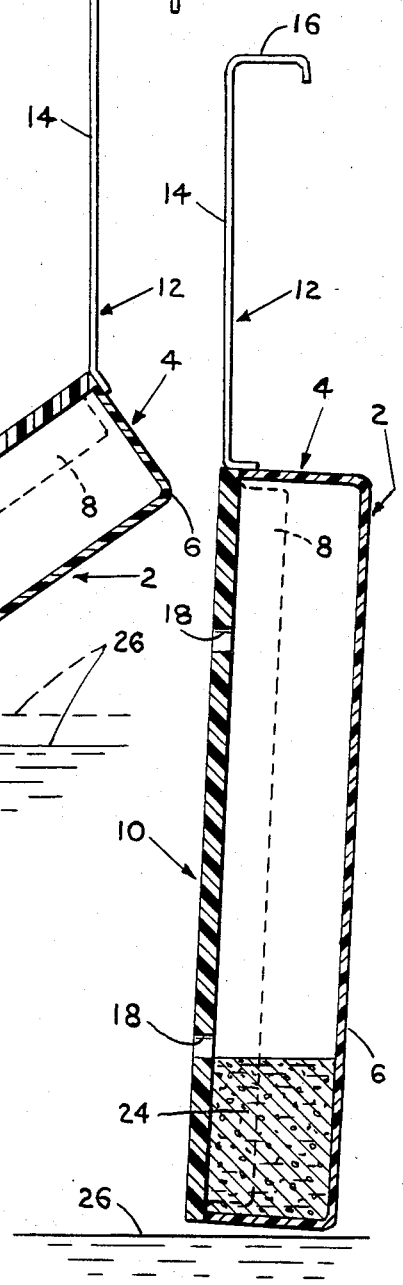
FIG. 4 is a side sectional view similar to FIG. 2, showing the dispenser fully rotated into the vertical position.

Thus, and referring briefly to FIGS. 3 and 4, the exact location of hole 18 in relation to the unsupported end of container 4, governs the quantity of fluid that will be released as the container tilts toward the vertical, as well as the quantity of fluid that will be taken in as the fluid level in the reservoir rises and the container tips back toward the floating, horizontal position. The exact location of this distal hole 18 may vary within the scope of the present invention, depending upon the size of receptacle 6 and the quantity of dispensable material that it is desired to release.

Figure 2:
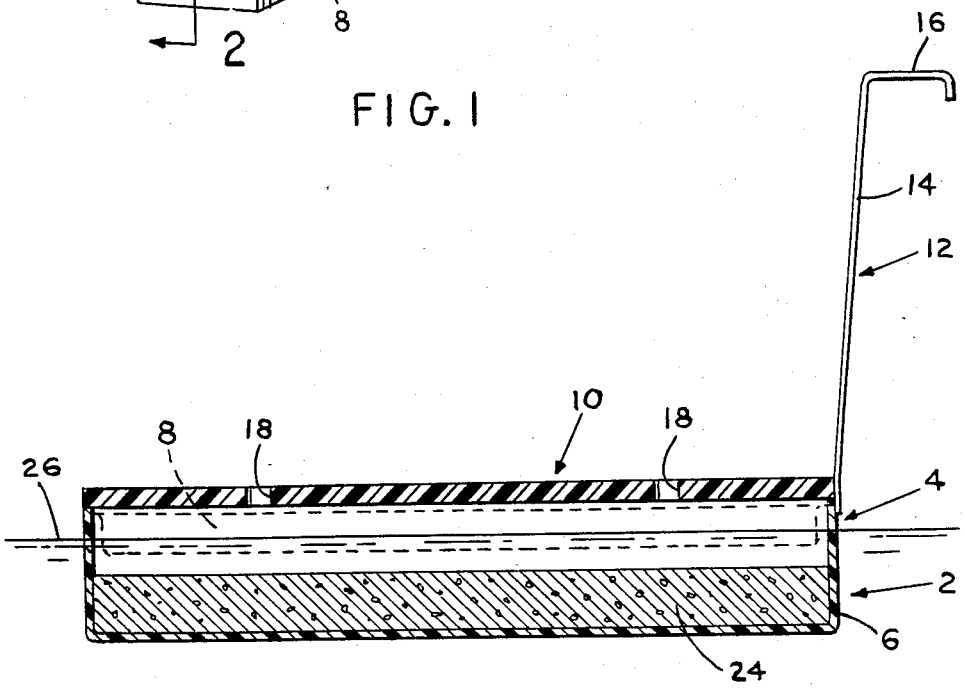
FIG. 2 is a side sectional view of the dispenser of FIG. 1, taken through line 2—2 thereof.

The operation of the device of FIG. 1 is illustrated with reference FIGS. 2–4. As mentioned above, the device of FIG. 1 is designed to release dispensable material labeled 24 herein into the fluid ambient 26 as the level of the ambient 26 in the reservoir drops. Thus, FIG. 2 illustrates dispenser 2 at rest and represents the position of dispenser when the reservoir, not shown herein, contains a maximum quantity of fluid 26. It can be seen from FIGS. 2–4 that the length of connector 14 governs the level at which dispenser 2 assumes a horizontal attitude in fluid 26. As mentioned earlier, the exact length of connector 14 may vary to suit the specific fluid environment and application of the dispenser.

Referring now to FIG. 3, it can be seen that fluid 26 is at a lower level than illustrated in FIG. 2, and accordingly that dispenser 2 has rotated about the pivot axis defined between connector 14 and the peripheral margin of container 6, in a downward direction toward a vertical attitude. The draining cycle of fluid 26 is represented by the solid line, and it can be seen that the quantity of dispensable material 24 that exceeded the level illustrated in FIG. 3 has escaped through distal hole 18 and has thereby mixed with fluid ambient 26 during its draining cycle.

As mentioned earlier, dispensable material 24 may comprise either a solid, a liquid, or a mixture of the two. In any event, the movement of dispensable fluid includes the formation of a mixture with the fluid ambient 26, which mixture is thereafter discharged into the remainder of the fluid body. Thus, the discharge of dispensable material 24 through distal hole 18, comprises the discharge of a mixture of ambient 26 and dispensable material 24.

Referring now to FIG. 4, the container 2 has rotated into the fully vertical position as shown, due to the maximum drainage of fluid 26 below the furthest level of extent capable by dispenser 2. In such instance, dispensable material 24 (or a solution thereof) has been fully discharged so that the remainder of dispensable material 24 resides at a level corresponding to the distance between distal hole 18 and the unsupported end of container 4. As mentioned earlier, the positioning of this distal hole 18 in conjunction with the operation of dispenser 2 to form a mixture of dispensable material 24 and fluid ambient 26 and to discharge a quantity of the same on each cycle of rotation, accomplishes the objectives of storing and isolating the majority of the dispensable material 24 while uniformly releasing a premeasured quantity thereof on a regulated, continuous basis.

Referring again to FIG. 3, and with respect to fluid 26 illustrated by the dotted line, the refilling of the reservoir and the raising of the fluid level results in the commencement of the rotation of dispenser 2 toward the horizontal position. During this rotation, and as illustrated in FIG. 3, a quantity of fluid ambient 26 now enters receptacle 6 through distal hole 18 and is thereby available to mix with a further quantity of dispensable material 24. The size of distal hole 18 and its position along cover 10 in relation to the quantity of dispensable fluid 24 remaining in dispenser 2, governs the quantity of fluid ambient 26 that now enters dispenser 2, so that careful control of the foregoing parameters assures corresponding control of the volumetric ratio of fluid ambient 26 to dispensable material 24 during each fluid refilling cycle.

Referring again to FIG. 2, the refilling of the reservoir is now complete and it can be seen that the dispensable material 24 has been increased in volume by a quantity of fluid 26, so that the resulting dispensable material 24 is equal in volume to that contained prior to the discharge cycle. As such, dispenser 2 is now ready for a further discharge sequence as fluid ambient 26 commences a further cycle of level variation.

The device illustrated in FIGS. 1–4 represents a first embodiment of the invention, wherein discharge of the dispensable material takes place as the level of the fluid ambient 26 in the reservoir drops. This sequence of discharge and refill is suitable in certain dispensing applications, however, may be undesirable in instances where it is desired that the material dispensed remain in the reservoir and become uniformly dispersed and active therein. In such instance, a dispenser in accordance with an alternate embodiment of the invention may be more suitable, and such dispenser is illustrated and designated 28 in FIGS. 5–8 herein.

Figure 5:
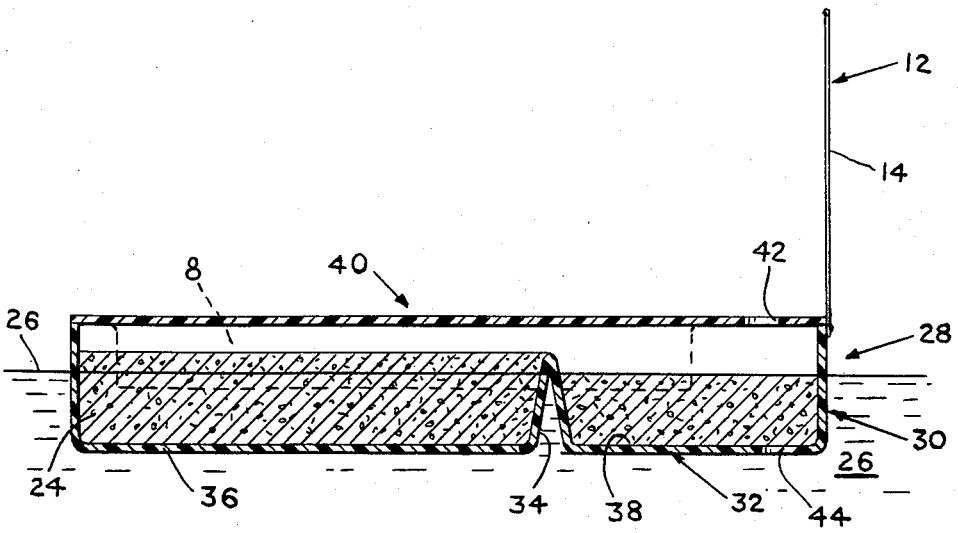
FIG. 5 is a side sectional view partly in phantom of a dispenser in accordance with an alternate embodiment of the present invention.

Referring now to FIG. 5, dispenser 28 is in general respects similar to dispenser 2 of FIGS. 1–4. Thus, a container 30 is disclosed with a receptacle 32 and buoyancy means such as pontoons 8 positioned in straddling relationship, as shown in phantom in the top view of dispenser 28, presented in FIG. 6. Likewise, a rim 22 is provided, to which pontoons 8 may be attached or within which they may be formed, all as described earlier herein. Similarly, receptacle 32 defines a mouth 20 that is positioned adjacent rim 22 and may in one embodiment be continuous and integral therewith.

Dispenser 28 also utilizes an attitude guide means 12 which as illustrated herein may comprise paired filaments, wires or strings as connectors 14. It is to be understood, however, that connectors 14 may comprise sheet materials, adhesive tape, and the like, as stated earlier herein.

Figure 6:
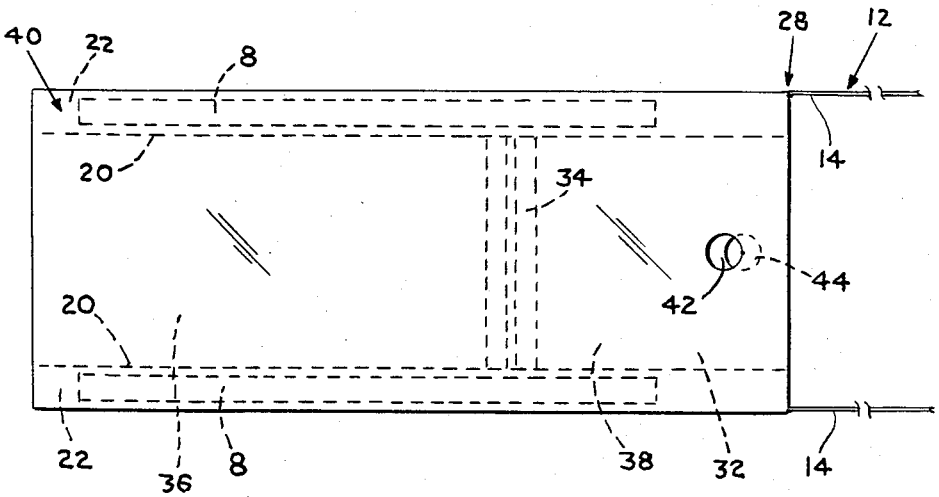
FIG. 6 is a top view of the dispenser of FIG. 5.

Dispenser 28 differs from dispenser 2 in the provision of a transverse partition 34 within receptacle 32. Receptacle 32 as illustrated, in similar fashion to receptacle 6 of FIGS. 1–4, has a greater longitudinal dimension and, in one embodiment, may be rectangular. In the instance, of the embodiment of FIGS. 5–8, and as illustrated in FIG. 6, partition 34 extends transversely to the greater longitudinal dimension of receptacle 32 and accordingly divides receptacle 32 into a first larger volumetric capacity compartment 36 and a second smaller volumetric capacity compartment 38. Partition 34 furthermore has a height that is less than the depth of receptacle 32 so that the dispensable material 24 within receptacle 32 may rise and flow over partition 34 as will be seen with reference to FIGS. 7 and 8 described later on herein.

A further structural distinction in dispenser 28 resides with the cover and metering means. Specifically, cover 40 while otherwise similar to cover 10, defines a single upper hole 42 as shown, while a second lower hole 44 is defined by container 30 and is preferably in substantial axial alignment with upper hole 42. Both holes are located in communication with second smaller volumetric capacity compartment 38 to facilitate the operation of the metering means of the present invention in the manner described later on herein. Upper hole 42 serves in similar capacity to the proximal hole 18 of the embodiment of FIGS. 1–4, in that it equalizes the pressure between the external atmosphere and the interior of container 30, to permit dispensable material 24 and ambient fluid 26 to flow regularly through lower hole 44 as will be described.

The operation of the dispenser 28 will now be described with reference to FIGS. 5, 7 and 8. Referring first to FIG. 5, dispenser 28 is shown in the fully floating, horizontal position, supported by ambient fluid 26. In this position, second compartment 38 contains a quantity of dispensable material 24 which is able to mix with the fluid ambient 26 and to disperse throughout the fluid contained in the reservoir. The buoyancy of dispenser 28 is such that it remains at the level shown in FIG. 5, which is lower than the level of fluid maintained within first compartment 36. Partition 34 thus rises to height greater than the level of the external fluid 26, and retains and thereby isolates the bulk of dispensable material 24. The exact quantity of dispensable material 24 released by dispenser 28 is governed by the size of the respective compartments 36 and 38, holes 42 and 44 and the height of partition 34. All of these dimensions may vary to assure that a specific quantity of dispensable material 24 is released during a given cycle.

The release and diffusion of dispensable material 24 at the highest fluid level in the reservoir, permits the dispensable material to reside in the reservoir for a period of time which in most instances is sufficient for any active ingredients in the dispensable material to perform their intended functions within the reservoir. Thereafter, when the reservoir is drained, so that the fluid level begins to decrease, dispenser 28 ultimately rotates toward the vertical attitude, as shown in FIG. 7, in similar fashion to dispenser 2 described above.

Figure 7:
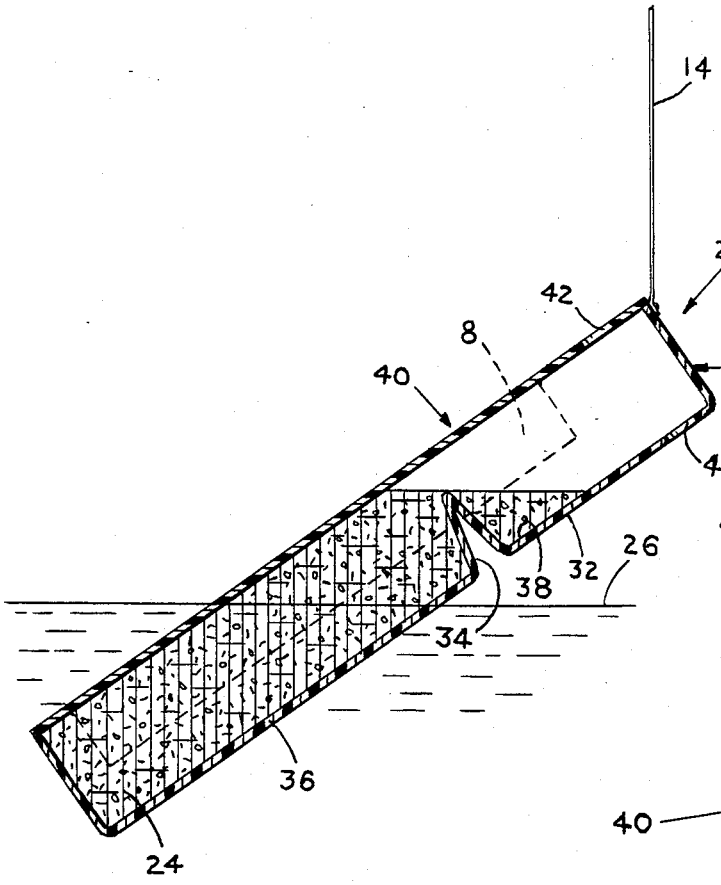
FIG. 7 is a side sectional view similar to FIG. 5, showing the dispenser in the tilted position.
Figure 8:
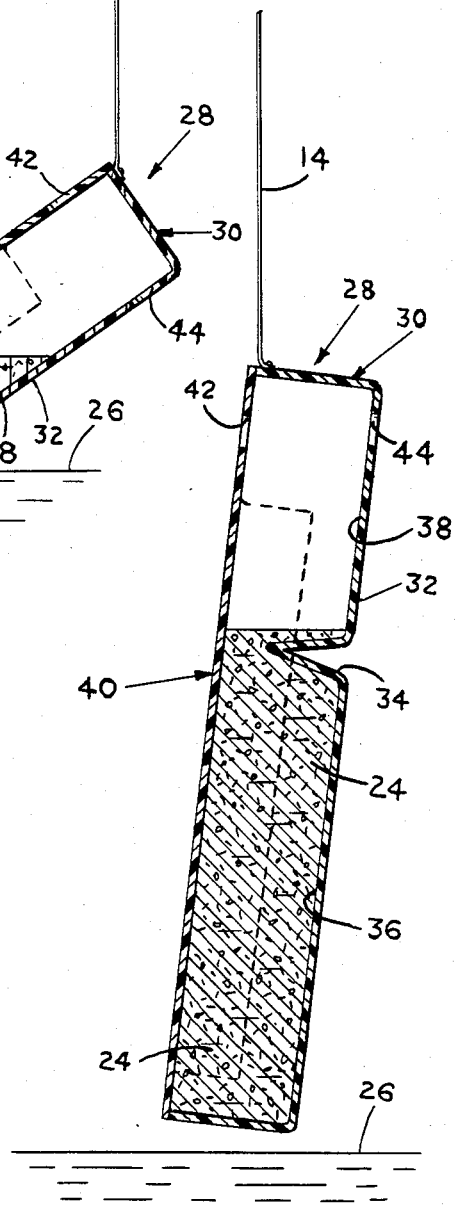
FIG. 8 is a side sectional view similar to FIG. 5, showing the dispenser in the fully rotated, vertical position.

Referring now to FIG. 7 the rotation of dispenser 28 to the vertical attitude permits a portion of the dispensable material 24 contained within first compartment 36 to travel over the upper edge of partition 34, and to transfer into second compartment 38. In this way, a select quantity of dispensable material 24 is positioned for later release. The full cycle of rotation is completely illustrated when review of FIG. 8 is made, as complete vertical suspension of dispenser 28 occurs when fluid level 26 sinks below the free end of container 30 and out of contact with dispenser 28. The refilling of second compartment 38 takes place as dispenser 28 begins to resume its horizontal attitude, with the rise in the level of fluid 26, as described with reference to FIG. 7. As soon as dispenser 28 resumes its full horizontal attitude as illustrated in FIG. 5, the dispensable material 24 is released into the fluid ambient 26.

The dispensers of the present invention may be prepared from a variety of well known materials, depending upon end use. Thus, in the instance where usable dispensers are contemplated, certain synthetic resins, metals and glass many be employed; in the instance where a throw-away dispenser is contemplated, less expensive plastics, including foam plastics, paper or cardboard, or other easily disposable materials may be utilized.

The dispenser provides the desired metering function in contrast to the prior art devices, and is thereby suitable for the continuous metered discharge of a variety of active ingredients into bodies of water having cyclical fluid level variations. As mentioned earlier, a particularly useful application of the present dispenser, is in the water tank of a toilet apparatus, where a variety of active ingredients such as detergents, perfumes, disinfectants, rust and stain removers, bleaches and the like may be dispensed. Also, the exact ingredients comprising the dispensable material, as well as the state of such material i.e., solid, liquid or mixed solid and liquid, may vary and would all be operable and useful in accordance with the dispensers of the present invention.

It is understood that the invention is not limited to the illustrations described and shown herein, which are deemed to be merely illustrative of the best modes of carrying out the invention, and which are suitable of modification of form, size, arrangement of parts and details of operation. The invention rather is intended to encompass all such modifications which are within the spirit and scope and defined by the claims.

What is claimed is:

1. A buoyant dispenser for suspension in a fluid reservoir with a cyclically variable fluid level, for the periodic delivery of a metered quantity of a dispensable material thereto, said dispenser comprising:

A. a container with a central receptacle for holding said dispensable material, said receptacle having a greater longitudinal dimension and having a partition extending transversely to the greater longitudinal dimension of said receptacle, said partition having a height less than the depth of said receptacle whereby the fluid within said receptacle may rise and flow over said partition, and said partition divides said receptacle into a first and a second compartment;

B. buoyancy means communicating with said container and straddling said receptacle;

C. a cover in fluid-tight engagement with said receptacle;

D. attitude guide means, attached to said container and adapted to be anchored to a wall of said fluid reservoir; and E. metering means in fluid registry with said receptacle to permit the controlled ingress and egress of said fluid, said metering means comprising a first hole located in said cover and a second hole located in said container in substantial axial alignment with said first hole, and in fluid registry with one of said compartments.

2. The buoyant dispenser of claim 1 wherein said receptacle has an open end defining a mouth, and said container defines an extended rim adjacent said mouth.

3. The buoyant dispenser of claim 2 wherein said buoyancy means comprises paired pontoons and said pontoons are attached to said rim.

4. The buoyant dispenser of claim 2 wherein said cover engages said mouth.

5. The buoyant dispenser of claim 2 wherein said cover is coextensive with said rim.

6. The buoyant dispenser of claim 5 wherein said buoyancy means comprises paired pontoons, and said pontoons are attached to said cover, along the portions thereof that are coextensive with said rim.

7. The buoyant dispenser of claim 1, wherein said receptacle has a greater longitudinal dimension.

8. The buoyant dispenser of claim 1, wherein said buoyancy means comprises paired pontoons.

9. The buoyant dispenser of claim 8 wherein said pontoons are attached to said container.

10. The buoyant dispenser of claim 8 wherein said pontoons comprise fluid-tight receptacles containing ambient air.

11. The buoyant dispenser of claim 8 wherein said pontoons comprise strips of buoyant foam material.

12. The buoyant dispenser of claim 1 wherein said attitude guide means comprises at least one longitudinally extended connector hingably attached to said container along a peripheral margin thereof, and at least one anchor means attached to said connector at the opposite end thereof, said anchor means adapted for attachment to the upper edge of a wall of said fluid reservoir.

13. The buoyant dispenser of claim 12 wherein said connector comprises a flexible sheet and said anchor means comprises a clip.

14. The buoyant dispenser of claim 12 wherein said connector comprises plural wires, and said anchor means comprises plural clips attached thereto.

15. The buoyant dispenser of claim 1 wherein said metering means comprises two centrally positioned, spaced apart holes.

16. The buoyant dispenser of claim 1 wherein said compartments are of unequal volumetric capacity and said holes are in fluid registry with the compartment having lesser volumetric capacity.

17. The buoyant dispenser of claim 1 wherein said dispensable material selected from the group consisting of solids, liquids and mixtures thereof.

* * * * *